United States Patent [19]

Allenspach

[11] 4,008,595

[45] Feb. 22, 1977

[54] METHOD AND APPARATUS FOR ARCUATELY BENDING AND ROLLING AN ELONGATED METALLIC WORKPIECE

[76] Inventor: Walter Allenspach, Bachtobelstrasse 66, CH-8560 Ottoberg, Switzerland

[22] Filed: Apr. 7, 1976

[21] Appl. No.: 674,631

[30] Foreign Application Priority Data

Apr. 8, 1975 Switzerland ..... 4409/75

[52] U.S. Cl. ..... 72/170; 72/341

[51] Int. Cl.[2] ..... B21D 7/08

[58] Field of Search ..... 72/170, 366, 166, 129, 72/131, 132, 107, 136, 324, 341

[56] References Cited

UNITED STATES PATENTS 1,158,294 10/1915 Robinson ..... 72/167

1,622,426 3/1927 Engelke ..... 72/167

*Primary Examiner*—Milton S. Mehr

*Attorney, Agent, or Firm*—Michael J. Striker

[57] ABSTRACT

An elongated workpiece is passed along an arcuate path defined by a pair of end rollers flanking a middle roller. At least one of the rollers is formed with a workpiece-receiving groove having flanks at least one of which has a milling formation for removing ridges that form on a workpiece passing along the arcuate path between the rollers. Thus, these ridges that form inherently on a workpiece that is bent are removed during the bending thereof to prevent the workpiece from jamming in the bending rollers.

10 Claims, 3 Drawing Figures

Y
25
3

24
31
15
20
28
26
D
19
27
21
29
32
D'
14
7
23
13
22
18
M
17
16

METHOD AND APPARATUS FOR ARCUATELY BENDING AND ROLLING AN ELONGATED METALLIC WORKPIECE

CROSS-REFERENCE TO RELATED APPLICATION

This application is related to my copending patent application Ser. No. 558,118 filed 13 Mar., 1975.

BACKGROUND OF THE INVENTION

The present invention relates to a system for treating an elongated workpiece. More particularly this invention concerns a method of and apparatus for bending a metallic bar or rod.

My above-described earlier application discloses a multi-function metal-working machine having a support with spaced ends and a longitudinal passage extending intermediate these ends. A carriage is mounted for displacement in and lengthwise of the passage and means is provided for so moving the carriage. At least one first tool holder is provided on the carriage and mounting means is located at least on one end of the support for mounting at least one second tool holder. The carriage is moved by means of a hydraulic or mechanical drive. A plurality of tool holders are mountable on the mounting means detachably and at least some of these tool holders are provided with projecting stub shafts.

It is known in such machines to form rods or bars, usually of steel, into rings or helicoids. This is carried out as described in my earlier patent application by passing the elongated metal workpiece between three rollers that define an arcuate path. The two end rollers engage the convex outside of the workpiece and the middle roller engages between these end rollers against the concave inner side of the workpiece. The rollers all rotate about parallel axes and at least the axis of the middle roller is displaceable toward the plane defined by the axes of the end rollers. Typically in such an arrangement the middle roller is moved inwardly after each pass of the workpiece between the rollers so as to bend the workpiece with each pass to an increasingly smaller radius of curvature.

Such an arrangement works with very little difficulty so long as the bending radius is not too small and/or the workpiece is not too thick. When, however, a relatively small bending radius is required, a relatively large-diameter workpiece must be bent, or a workpiece must be bent edgewise, it is necessary to form grooves on the bending rollers in order to guide the workpiece as it is bent. Otherwise the workpiece will slip on the tools and uniform bending results will not be obtained.

The principal problem created by the provision of such guide grooves is that when a thick workpiece must be bent, a workpiece must be bent edgewise, or a workpiece must be bent through a relatively small radius, ridges form on the concave inner surface of the workpiece as well as on the sides of the workpiece flanking this inner concave side. Such formations increase the size of the workpiece so as often to cause it to jam up in the guide groove and prevent the machine from operating altogether. Thus it is necessary to provide relatively wide guide grooves in such devices in order to prevent such jamming, with the concomitant disadvantages that uneven bending results are often obtained.

SUMMARY OF THE INVENTION

It is therefore an object of the present invention to provide an improved method of and apparatus for treating an elongated workpiece.

Another object is to improve on the apparatus described in my above-cited copending patent application.

Yet another object is to provide an improved method and apparatus for bending even a relatively thick workpiece through a relatively tight radius without danger of this workpiece jamming up in the device.

These objects are attained according to the present invention in an arrangement wherein as the workpiece passes longitudinally along an arcuate path defined by three bending rollers the ridges that form on this workpiece during bending are machined off the workpiece. Thus the principal cause of jamming-up of the workpiece in the machine is eliminated in accordance with the method of the present invention. In fact with this method it is possible to bend the workpiece to the absolute limit of its elasticity on its outer surface without the workpiece jamming in the machine. It is therefore possible to bend the elongated workpiece edgewise, that is to bend a workpiece in a plane parallel to its major cross-sectional dimension.

In accordance with further features of this invention the method is carried out by providing at least one of the flanks of the groove of at least one of the rollers with machining formations which automatically machine off the ridges as the workpiece passes through this groove. Such a structure adds practically nothing to the cost of the rolling and bending installation and allows such an installation to carry out tasks that hitherto have been impossible.

According to further features of this invention the roller having the machining formation is formed of a pair of cheek plates separated by a spacer ring. At least one of these cheek plates has on its inner face which lies in a plane perpendicular to the axis of rotation of the respective roller a plurality of radially extending grooves having sharp edges that serve to mill off the ridges on the workpiece. These grooves extend radially and at their radially inner ends terminate at throughgoing holes that allow chips to fall out of the roller to prevent these chips from building up on the base of the groove and impairing functioning of the machine. The spacer ring between the cheek plates has an axial height equal to slightly more than the dimension of the workpiece perpendicular to the plane it is to be bent in so that whenever ridges form they are milled off by these machining formations.

The novel features which are considered as characteristic for the invention are set forth in particular in the appended claims. The invention itself, however, both as to its construction and its method of operation, together with additional objects and advantages thereof, will be best understood from the following description of a preferred embodiment when read in connection with the accompanying drawings.

DESCRIPTION OF THE PREFERRED EMBODIMENT

Figure 1:
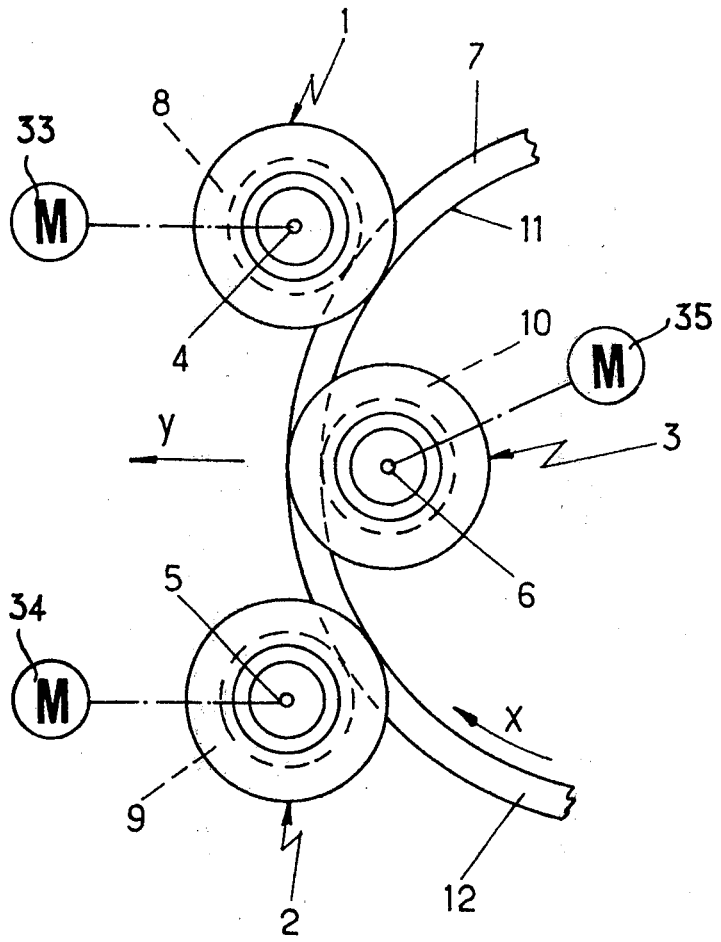
FIG. 1 is a top generally schematic view of the apparatus according to this invention.

As shown in FIG. 1, the bending/rolling apparatus according to this invention comprises a pair of end rollers 1 and 2 to either side of a middle roller 3. These rollers 1, 2 and 3 are rotatable about respective parallel axes 4, 5 and 6 by means of respective motors 33, 34, and 35. The motor 33 rotates the roller 1 slightly faster than the motor 35 rotates the roller 3 which in turn rotates faster than the roller 2 for limited elongation of a workpiece 7 passing through grooves 8, 9 and 10 in these rollers 1, 2, and 3, respectively. As the workpiece 7 is advanced along the indicated arcuate path in the direction of arrow X its concave inner face 11 engages the roller 3 and its convex outer face 12 engages the rollers 1 and 2. With each pass of the workpiece 7 the roller 3 is moved in the direction of arrow Y toward the rollers 1 and 2 to decrease the radius of curvature imparted to the workpiece 7.

Figure 2:
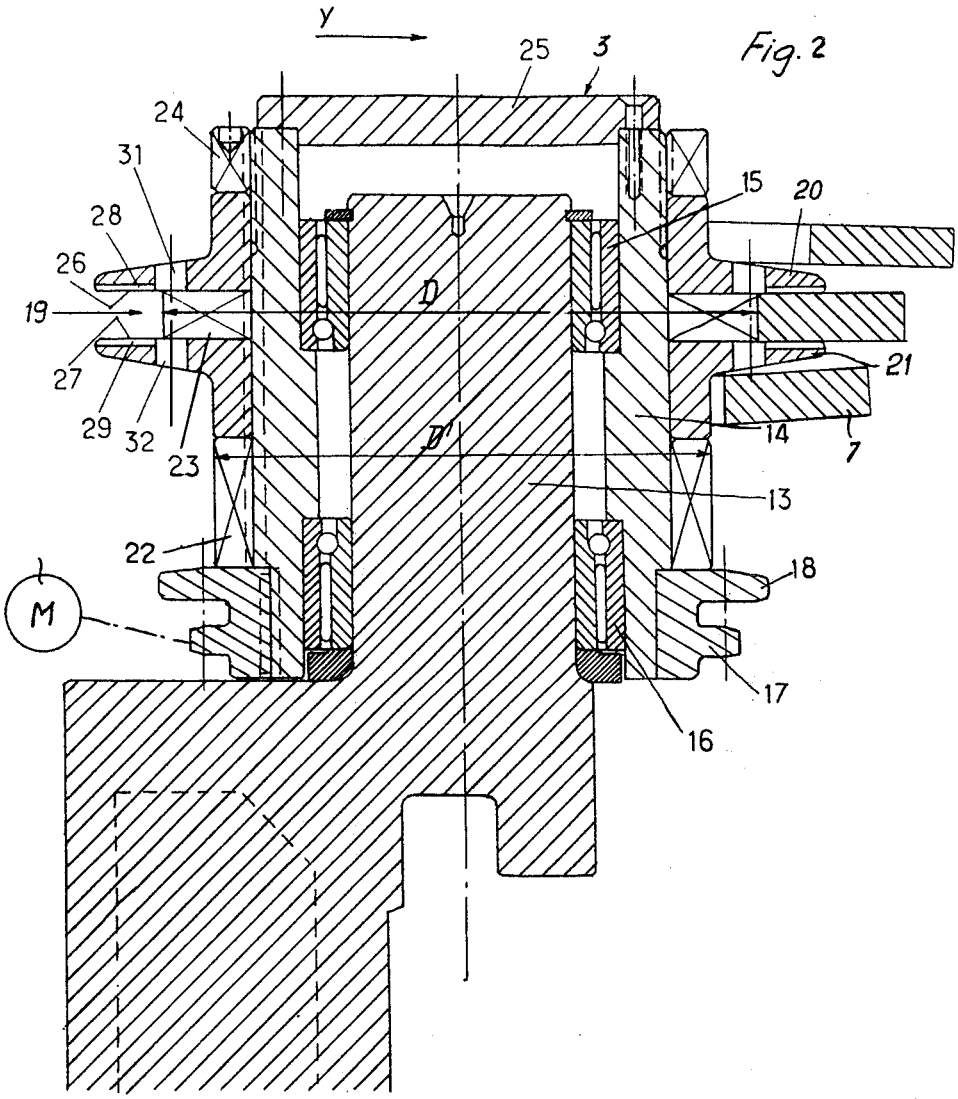
FIG. 2 is an axial section through the middle roller shown in FIG. 1.

The roller 3 shown in FIG. 2 is carried on an offset shaft 13 and has an inner sleeve 14 rotatably supported on this shaft 13 on roller bearings 15 and 16. At its bottom the sleeve 14 is provided with a sprocket 17 connected to the motor 35.

A top flange 18 of this sprocket ring 17, which is keyed or screwed to the sleeve 14, supports a spacer ring 22 on which rests a lower cheek plate 21 forming with an upper cheek plate 20 and a spacer ring 23 the roller 3. The cheek plates 21 and 20 and the ring 23 are keyed to the sleeve 14 and a threaded clamping ring 24 presses these elements down against the spacer ring 22 and against the fixed support flange 18.

Figure 3:
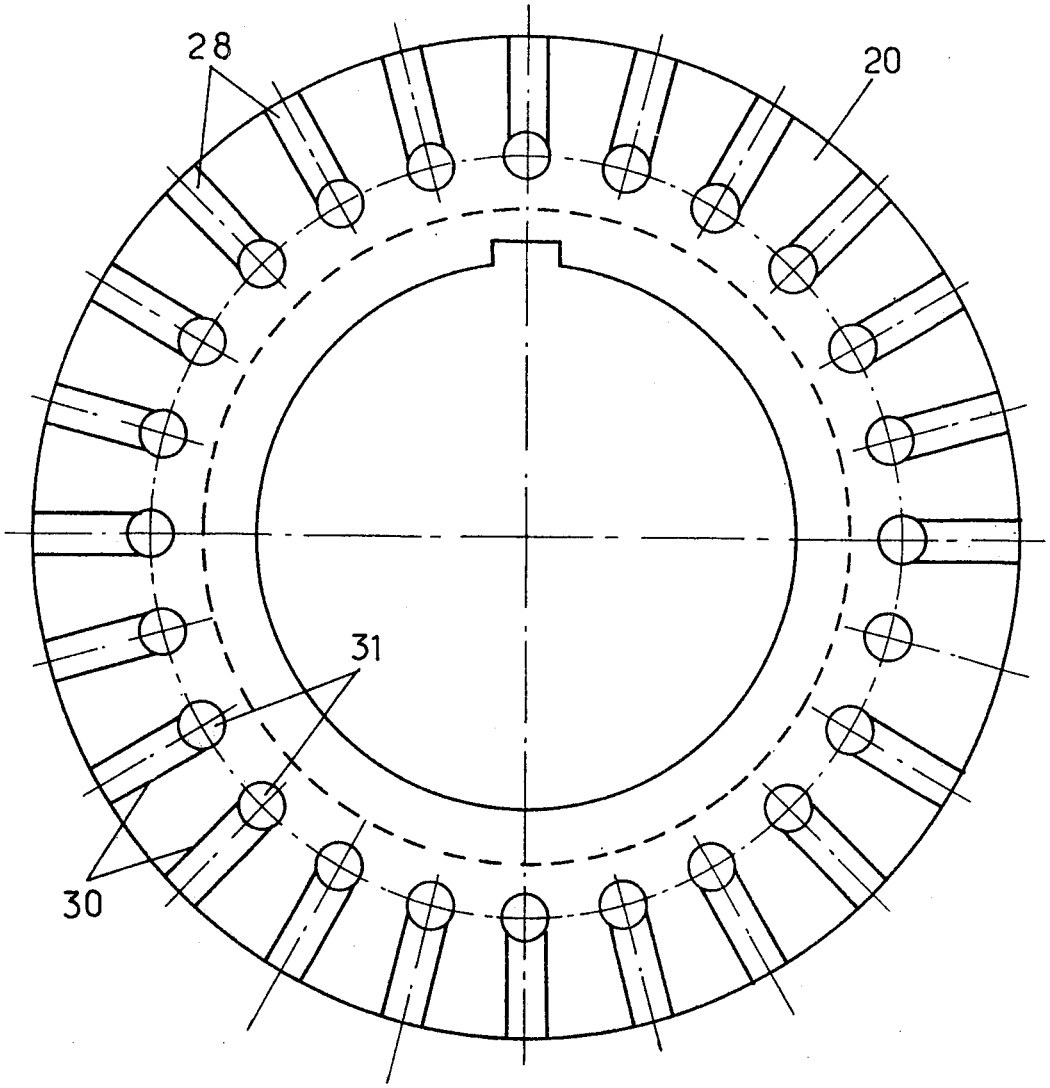
FIG. 3 is an axial view of one of the cheek plates of the roller of FIG. 2.

The cheek plates 20 and 21 have planar faces 26 and 27 turned toward one another and lying in respective spaced-apart planes perpendicular to the axis 6. Each of these faces 26 and 27 as shown in FIG. 3 is formed with an array of radially extending grooves 28 and 29 which extend from the radially outer edge of the respective plates 20 and 21 inwardly where they terminate at respective axially throughgoing holes 31 and 32. These holes 31 and 32 lie at the base of the groove 10 formed by the plates 20 and 21 and, in fact, extend radially inwardly somewhat beyond the outer periphery of the spacer ring 23.

As the workpiece 7, shown to be helicoidal in FIG. 2, fits in the groove 10 any ridges formed on its upper and lower surfaces will be machined off by the sharp edges of these grooves 28, as the plates 20 and 21 are made of tool steel capable of milling the helicoidal workpiece 7.

The roller 3 has a diameter D at the base of the groove 10 and a diameter D′ substantially smaller than this diameter D above and below the plates 20 and 21. Thus, the workpiece may advance helically to either axial side of the roller without coming into engagement with it so that the device may readily be used to make a long helicoidal workpiece. The axial height of the spacer ring 23 is slightly greater than the diameter of the round-section workpiece 7 so that only laterally projecting ridges or bosses on this workpiece 7 will be machined therefrom. The chips and small metal pieces machined off the workpiece 7 will exit from the groove 10 through the holes 31 and 32.

It is noted that only one of the plates 20 or 21 need be formed with milling formations. Furthermore either or both of the rollers 1 and 2 can be formed the same as roller 3. It is also possible to form the shaft 13 and sleeve 14 much longer so as to accommodate relatively lengthy helicoidal workpieces which can then wind up fully above and below the roller assembly so that once one end of the workpiece is reached the drive directions need merely be reversed in order to rewind it, after moving the roller 3 in slightly.

It will be understood that each of the elements described above, or two or more together, may also find a useful application in other types of machines, differing from the types described above.

While the invention has been illustrated and described as embodied in a bending assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of treating an elongated workpiece comprising the steps of: orienting three bending rollers to define an arcuate path; passing said workpiece longitudinally along said path to bend said workpiece into an arcuate shape, whereby ridges form on said workpiece during such bending; and machining said ridges off said workpiece at least partially as said workpiece passes along said path.

2. The method defined in claim 1 wherein said ridges are milled off said workpiece.

3. The method defined in claim 2 wherein one of said rollers has a groove receiving said workpiece and has in said groove a milling formation, said milling taking place in said one roller.

4. The method defined in claim 1 wherein said rollers are rotated at different speed.

5. The method defined in claim 1 wherein said rollers rotate about parallel axes, said workpiece moving generally axially outside said path.

6. The method defined in claim 5 wherein said workpiece moves axially as a helix outside said path.

7. An apparatus for treating an elongated workpiece, said apparatus comprising a pair of end rollers and a middle roller, said rollers defining an arcuate path for said workpiece and at least one of said rollers being formed with a workpiece-receiving groove having flanks at least one of which has a machining formation for removing ridges on a workpiece passing along said path between said rollers.

8. The apparatus defined in claim 7 wherein said one roller has a pair of cheeks each forming a respective one of said flanks.

9. The apparatus defined in claim 8 wherein said one roller further comprises a replaceable spacer ring between said cheeks.

10. The apparatus defined in claim 7 wherein said roller is rotatable about an axis and is of substantially smaller diameter axially beyond said cheeks than at said cheeks and therebetween, whereby said workpiece may advance helically to either axial side of said one roller.

* * * * *